US011524422B2

(12) United States Patent
Schwab

(10) Patent No.: US 11,524,422 B2
(45) Date of Patent: Dec. 13, 2022

(54) METHOD OF OPERATING A FLAT-BED DIE CUTTER

(71) Applicant: HEIDELBERGER DRUCKMASCHINEN AG, Heidelberg (DE)

(72) Inventor: Werner Schwab, Bechtsrieth (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 17/123,926

(22) Filed: Dec. 16, 2020

(65) Prior Publication Data

US 2021/0187772 A1 Jun. 24, 2021

(30) Foreign Application Priority Data

Dec. 18, 2019 (EP) ..... 19217278

(51) Int. Cl.

| | |
|---|---|
| ***B26D 7/18*** | (2006.01) |
| ***B26D 7/01*** | (2006.01) |
| ***B26D 7/32*** | (2006.01) |
| ***B26F 1/44*** | (2006.01) |

(52) U.S. Cl.

CPC ..... *B26D 7/1818* (2013.01); *B26D 7/015* (2013.01); *B26D 7/32* (2013.01); *B26F 1/44* (2013.01); *B26D 2007/322* (2013.01); *B26F 2001/4436* (2013.01)

(58) Field of Classification Search

CPC ..... B26D 7/18; B26D 7/1818; B26D 7/015; B26D 7/32; B26D 2007/322; B26D 9/00; B26F 1/40; B26F 3/002; B26F 1/44; B26F 2001/4436; B26F 1/04; Y10T 83/4529; Y10T 83/9418; Y10T 83/943

See application file for complete search history.

(56) References Cited

U.S. PATENT DOCUMENTS

| | | | | | |
|---|---|---|---|---|---|
| 4,611,518 | A * | 9/1986 | Hildebrandt | B26D 7/18 | 83/373 |
| 4,851,075 | A * | 7/1989 | Parker | B65H 35/10 | 156/556 |
| 5,101,747 | A * | 4/1992 | Gerber | B26D 7/1818 | 112/470.13 |
| 5,470,004 | A * | 11/1995 | Mineki | B26D 7/18 | 225/99 |
| 5,697,272 | A * | 12/1997 | Tsuzaki | B26D 5/20 | 234/1 |

(Continued)

FOREIGN PATENT DOCUMENTS

| | | | |
|---|---|---|---|
| DE | 202004010796 | U1 | 9/2004 |
| DE | 102012019992 | A1 | 4/2014 |
| EP | 2080600 | A1 | 7/2009 |

*Primary Examiner* — Jonathan G Riley

(74) *Attorney, Agent, or Firm* — Laurence A. Greenberg; Werner H. Stemer; Ralph E. Locher

(57) ABSTRACT

In a method of operating a flat-bed die-cutter a printing substrate in the form of a web is fed to a die-cutting module of the flat-bed die-cutter, a web section is severed from the web and removed as waste. The web is guided through the die-cutting module and the web section is severed from the web in or downstream of the die-cutting module and removed as waste. Products are thus formed by die-cutting a web while reducing waste and periods of standstill.

5 Claims, 3 Drawing Sheets

(56) References Cited

U.S. PATENT DOCUMENTS 5,826,474 A * 10/1998 Howard ..... B65H 35/06 83/423
6,003,420 A * 12/1999 Wakabayashi ..... B26D 9/00 83/214
6,257,112 B1 * 7/2001 Wakabayashi ..... B26D 9/00 83/214
6,467,382 B2 * 10/2002 Willits ..... B26D 7/18 225/104
6,571,983 B1 * 6/2003 Schumann ..... B26D 7/18 221/25
7,137,328 B1 * 11/2006 Tilton ..... B23D 17/06 83/527
7,156,007 B1 * 1/2007 Albin ..... B26D 1/225 264/160
8,408,110 B2 4/2013 Krauss et al.
2003/0197298 A1 * 10/2003 Hegishi ..... B29C 53/18 264/40.6
2004/0066441 A1 * 4/2004 Jones ..... B41J 2/01 347/101
2005/0000842 A1 * 1/2005 Timmerman ..... B65B 27/08 206/449
2005/0206066 A1 * 9/2005 Bittner ..... B65H 3/0816 271/9.12
2006/0191426 A1 * 8/2006 Timmerman ..... B31B 50/88 101/24
2006/0233995 A1 * 10/2006 Garland ..... B31D 1/026 428/41.8
2009/0183616 A1 * 7/2009 Krauss ..... B26F 1/40 83/685
2010/0021221 A1 * 1/2010 Bryant ..... B41J 3/44 400/61
2010/0080643 A1 * 4/2010 Toshito ..... B65H 35/08 400/621
2010/0199822 A1 * 8/2010 De Marco ..... B26D 5/32 83/331
2011/0192263 A1 * 8/2011 De Marco ..... B26D 5/32 83/343
2014/0102321 A1 * 4/2014 Hanau ..... B26F 1/40 101/32
2014/0179503 A1 * 6/2014 Rau ..... B26F 1/40 493/357
2014/0318338 A1 * 10/2014 Horii ..... B26D 7/18 83/102
2015/0020662 A1 * 1/2015 Yamada ..... B26D 7/18 83/111
2016/0091398 A1 * 3/2016 Pluemer ..... G05B 19/4065 702/183

* cited by examiner

METHOD OF OPERATING A FLAT-BED DIE CUTTER

CROSS-REFERENCE TO RELATED APPLICATION

This application claims the priority, under 35 U.S.C. § 119, of European patent application EP 19217278, filed Dec. 18, 2019; the prior application is herewith incorporated by reference in its entirety.

BACKGROUND OF THE INVENTION

Field of the Invention

The invention relates to a method of operating a flat-bed die-cutter wherein a printing substrate is fed to a die-cutting module of the flat-bed die-cutter in the form of a web, a web section is severed from the web, and removed as waste.

The technical field of the invention is the field of the graphic industry, in particular the field of the further processing of sheet-shaped or web-shaped printing substrates such as paper, cardboard, paperboard, or foil, in an in-line or off-line die-cutting process, in particular the field of flat-bed die-cutting.

A known process is to print on a web of printing substrate in a printing machine and to further process the substrate in a flat-bed die-cutter in an in-line or off-line process. A problem that may occur in this process is that stopping the printing machine and restarting it in the case of a job change may result in a phenomenon known as curling of the web while the machine is at a standstill—i.e. in the formation of undesired waves or other deformation of the web or other damage such as wavy web edges. The curling phenomenon may be caused by changes in humidity and/or ambient temperature, for example. It may cause problems when the printing substrate is processed. When the machine is restarted, the register may shift, i.e. the printed image and the die-cutting image may no longer be in register.

It is furthermore known to remove an unusable (e.g. curled) web section as waste before any further processing of the web, i.e. before the die-cutting process and upstream of the flat-bed die-cutter, for instance by winding it up. A problem of this process is that after restarting, the transporting of the web needs to be interrupted once again to introduce the leading edge of the web into the die-cutter and to readjust the register before production can be resumed. Thus a standstill during production results in a considerable amount of waste.

United Stated publication US 2014/0102321 A1 and its counterpart German published patent application DE 10 2012 019 992 A1 disclose a flat-bed die-cutter in which an unusable and unprinted section of the web is wound up upstream of the flat-bed die-cutter and cut off for removal. For this purpose, the web is unwound and conveyed backwards before being cut off, and once it has been cut off, it is moved forward while tension in the web is maintained. The new leading edge of the web that has been created needs to be reintroduced into the flat-bed die-cutter. In addition, the register needs to be readjusted.

BRIEF SUMMARY OF THE INVENTION

It is accordingly an object of the invention to provide a method of operating a die-cutter which overcomes the above-mentioned disadvantages of the heretofore-known devices and methods of this general type and which makes it is possible to produce products by die-cutting a web while reducing the amount of waste and periods of standstill. It is a particular object to provide a fast way of starting up a flat-bed die-cutter when production starts (new job) and in particular to avoid any further stops of the flat-bed die-cutter that may be required during start-up due to what is known as curling.

With the above and other objects in view there is provided, in accordance with the invention, a method of operating a flat-bed die-cutter, the method comprising:

feeding a printing substrate in the form of a web to a die-cutting module of the flat-bed die-cutter and guiding the web through the die-cutting module;

severing a web section from the web in the die-cutting module or downstream of the die-cutting module; and removing the web section as waste.

In other words, the above and other objects are achieved by the novel method of operating a flat-bed die-cutter which comprises the steps of feeding a printing substrate in the form of a web to the die-cutting module of the flat-bed die-cutter, severing a web section from the web and removing it as waste, guiding the web through the die-cutting module and severing the web section from the web in or downstream of the die-cutting module and removing it as waste.

The invention advantageously provides a way of creating products by die-cutting a web while reducing waste and periods of standstill.

Moreover, the invention advantageously provides a fast way of starting up a flat-bed die-cutter when production is started (new job).

In addition, the invention advantageously prevents a flat-bed die-cutter from having to be restopped during start-up due to the curling effect for instance for color matching purposes or what is known as proofing.

And, last but not least, the invention advantageously provides a way of implementing what is referred to as the phasing-in of the flat-bed die-cutter in an automated and in-register way: The web (which is running again after a production change) may be severed, an unusable section of the web (for instance in the form of a web section or sheet) may be removed from the running web as waste and the running web may be processed, preferably die-cut, in an in-register way. These features advantageously reduce downtime of the machine and the amount of substrate waste that is created.

A preferred further development of the invention may be characterized in that the web section is cut off by means of a die-cutting knife of a die-cutting tool or by means of a die-cutting knife of the die-cutting module or is only partly cut off by means of a die-cutting knife of a die-cutting tool or by means of a die-cutting knife of the die-cutting module and subsequently torn off, or is cut off by means of two die-cutting knives of the die-cutting module or only partly cut off by means of two die-cutting knives of the die-cutting module and then torn off. The die-cutting knife may be a sheet separation knife or a sheet perforation knife. The die-cutting knife may be disposed in a direction transverse to the direction of web travel and in a correspondingly different position in the direction of web travel as a function of the format to be processed. In a case in which two die-cutting knives are provided, one may be disposed at the leading edge of the sheet (upstream of the copies on a sheet, e.g. at a distance of 1 to 2 mm to the previous copy) and one at the trailing edge of the sheet (downstream of the copies on a sheet). The die-cutting knife may be a margin knife (or two margin knives, one on each side of the web) that does not sever the whole web but only the lateral margins to the sides of the outer copies.

The term "upstream," as used herein refers to a position that is before or ahead of the reference structure in the process flow or transport direction during the regular operation of the system. The term "downstream" refers to a position following in the process flow or transport direction.

A preferred further development of the invention may be characterized in that the web section is cut off by a cross-cutter that rotates or moves up and down and is different from the die-cutting knife of the die-cutting module or is only partly cut off by a cross-cutter that rotates or moves up and down and is different from the die-cutting knife of the die-cutting module and is then torn off. The cross-cutter may in particular sever the margins of the web.

A preferred further development of the invention may be characterized in that the severed web section is moved, preferably pulled, out of the die-cutting module by means of a pair of rollers. Preferably at least one of the rollers of the pair is a driven roller, in particular a roller driven in an intermittent way and/or in synchronism with the die-cutting cycle.

A preferred further development of the invention may be characterized in that the cross-cutter is disposed upstream or downstream of the pair of rollers.

A preferred further development of the invention may be characterized in that the substrate waste is removed as a web and wound up on a winding roller.

A preferred further development of the invention may be characterized in that the substrate waste is removed as sheets and deposited or shredded, in particular with the use of a guide plate.

A preferred further development of the invention may be characterized in that the sheet is removed from a transport path by means of a deflector.

A preferred further development of the invention may be characterized in that the die-cutting module is phased in, i.e. that while or after the web section is removed, the die-cutting module is activated and/or operated in an in-register way and at a speed matching that of a printed image of a print on the web.

A preferred further development of the invention may be characterized in that the feeding of the web to the flat-bed die-cutter and the passing of the web through the die-cutting module is started at the beginning of a production run and is continued without any stop during the removal of the web section and the in-register die-cutting operation and is only stopped at the end of the production run.

The following paragraphs (numbers 1 to 15) are a detailed description of a concrete preferred first further development of the method of the invention of operating a flat-bed die-cutter using a winding roller.

1. If it has not already done so, the die-cutter may move to a service position. In the service position, the gap between an upper die-cutter platen and a lower die-cutter platen in a die-cutting module may be greatest.
2. The desired die-cutting format and, if applicable, the ratio between die-cutting copy and print image copy may be predefined, for instance input by an operator or read out of a digital memory such as a cloud-based memory. Alternatively, the ratio between die-cutting copy and print image copy may be determined by means of a register sensor or register camera or code reader. Alternatively, a bar code or two-dimensional code such as a QR or data matrix code may be provided on the web for the value to be read out. A further alternative is that the value is automatically provided by a printing machine that is upstream of the flat-bed die-cutter in spatial and/or production terms.
3. If it has not been done already, the web of material may be fed into an inlet region of the die-cutting module, for instance a roller arrangement upstream of the die-cutting module, and in the process may contact a pull-in roller and an advancement roller (or a number of such rollers) and potentially counterpart rollers.
4. An alternative case (to point 3) is that the web of material is already in the inlet region and (only) the curled web section is to be removed.
5. The web of material may be moved through the die-cutting module and fixed to a winding roller.
6. A web infeed may be activated (start of an infeed mode). In this process, the value of a distance or path length between a die-cutting register mark (on the printing substrate) and a separating knife of the die-cutting module may be defined, e.g. by an operator's input or by being read out of a digital memory such as a cloud-based memory. Alternatively, the distance may be automatically measured by means of a register sensor or register camera or code reader. Alternatively, a bar code or two-dimensional code such as a QR or data matrix code may be provided on the web for the value to be read out. A further alternative is for the value to be automatically provided by a printing machine disposed upstream of the flat-bed die-cutter in spatial and/or production terms.
7. The initiation of the "infeed" mode may cause the winding roller to be switched on/rotated and pulling action/tension is built up in the web. A (web) storage roller may be moved to an optimum position and stopped/held in this position. An advancement roller may be switched from discontinuous operation to continuous operation. Kicking rollers that convey sheets out of the die-cutting region during a die-cutting operation may move to the optimum position (open) and then stop. If a winding roller is disposed below a sheet-transporting device, a lower one of the two kicking rollers may rotate continuously at web speed and the upper one of the two kicking rollers may be in an "open" position.
8. The die-cutter (and, if applicable, the upstream printing machine or an offline unwinding device preferably including a pulling unit and tools) may be started and the web may be moved continuously. In this process, the pull-in roller may convey the web into the die-cutter and the winding roller may convey the web through and out of the die-cutter. Movable deflection/guide rollers may be moved into the web path, preferably by about 20 mm.
9. The position of the register mark may be watched or monitored. The register mark may have been pre-printed onto the web or it may be printed in the printing machine. A preferred or optimum phasing-in time may be calculated or predefined. This phasing-in time is the point in time at which the die-cutting module of the die-cutter is activated and starts the in-register die-cutting operation at a precisely matched speed. The die-cutting operation takes place in an in-register way if the die-cutting register matches the print register.
10. The in-register phasing in into the die-cutting operation may be manually initiated by the operator. Alternatively, it may be initiated as a function of a length of a travel path preferably defined and/or determined and/or calculated in advance, for instance the length of a path of substrate web travel from an unwinding device (or any other web infeed to the die-cutter) to the die-cutter. In accordance with another alternative, it may be initiated by a continuous-operation sensor arrangement for detecting curling, wherein the initiation preferably occurs when the curling drops below a threshold, preferably a predefined threshold.

11. At the instant of starting of the phasing-in, the web may be moved to a suitable register position, preferably a calculated or predetermined register position. An advancement roller that had been activated for this purpose may then be stopped. If the length of a path to the suitable register position has already been exceeded, a corresponding portion of length of a sheet/web section to be die-cut may be moved into the die-cutting module and up to the suitable register position. Then the advancement roller may be stopped and a die-cutter platen of the flat-bed die-cutter may move in the direction of the web, preferably upward. In this process, the pulling action on the web and/or web tension at the winding roller is preferably maintained. Then the process of cutting the blanks using a cutting die of the die-cutter platen. The pulling action that the winding roller applies to the web and that may generate a stronger pulling force in the web at the instant of cutting, may then cause the web to tear at the locations of the cuts. To avoid a grid tear, a knife may optionally be placed at the cutting location of the first blank at the sides of the sheet in the cutting die. This may ensure a controlled cut-off at a desired location. Alternatively, an additional severing knife may cut the web at a desired location, for instance 2 mm downstream of the maximum inserting position.

12. At the same time, the web may be continuously conveyed by the pull-in roller.

A movable storage roller may store the conveyed web, i.e. a web section preferably of a predefined length. The storage roller may be moved by a cam disc.

13. When the die-cutter platen moves away from the web again, preferably in a downward direction, the winding roller may be operated at low web tension, and the advancement roller may convey the web into the die-cutter again. The die-cut sheet may be conveyed out of the die-cutting module by one or more kicking rollers. For this purpose, the lower kicking roller may be switched into the "kicking" (sheet-conveying) mode. At the same time, the movable deflection/guide rollers may move away from the web again, preferably by about 20 mm.

14. After a short, preferably predefined, period of time, the winding roller may be switched off in an automated way.

15. Now the flat-bed die-cutter may run in the standard operating mode to produce blanks. The "infeed" mode is completed.

The following paragraphs (points 1 to 15) are a detailed description of a concrete preferred second further development of the method of the invention of operating a flat-bed die-cutter using a waste delivery. Some of the points of the aforementioned first concrete further development remain unchanged:

1. Unchanged.
2. Unchanged.
3. Unchanged.
4. Unchanged.
5. A web infeed may be activated (start of an infeed mode). In this process, a waste deflector may be activated, i.e. it may be switched to a mode or moved into a position in which it directs waste to a waste delivery. The web of material may be moved through the die-cutting module and a portion of it may be moved into the waste deflector, for instance a 0.5 m portion, for instance by a pushing or pulling action. The web may contact a roller such as a pull roller with a counterpart roller, in the waste delivery.
6. Unchanged.
7. The start of the "infeed" mode may cause a cross-cutter of the waste delivery to be activated and operated in synchronism with web advancement. A (web) storage roller may be moved to an optimum position and stopped/held in this position. An advancement roller may be switched from discontinuous operation to continuous operation. Kicking rollers may move into an optimum position ("open") and stop, if desired.
8. The die-cutter (and, if applicable, the upstream printing machine) may be started and the web may be moved continuously. In this process, the pull-in roller and, if applicable, the advancement roller may convey the web into the die-cutter and up to the waste deflector. The cross-cutter may sever the web, preferably immediately downstream of the deflector, and deposit the severed section, preferably via a guide plate. Alternatively, the sheet may be moved to a shredder.
9. Unchanged.
10. Unchanged.
11. At the instant when the phase-in starts, the web may be moved to a suitable register position, preferably a calculated or predetermined register position. An advancement roller that had been activated for this purpose may then be stopped. If the length of the path to the suitable register position has already been exceeded, a corresponding portion of the length of a sheet/web section to be die-cut may be moved into the die-cutting module and up to the suitable register position. Then the advancement roller may be stopped and a die-cutter platen of the flat-bed die-cutter moves in the direction of the web, preferably upward.
12. A cutting die of the die-cutter platen cuts the blanks. One or more kicking rollers may convey the remaining web out of the die-cutter. The waste deflector is deactivated, i.e. switched back into a production mode or moved into a production position as soon as the severed web has passed the deflector. At the same time, the web may be continuously conveyed by the pull-in roller.

A movable storage roller may store the conveyed web, i.e. a web section, preferably a web section of predefined length. The movement of the storage roller may be effected by a cam disc.

13. When the die-cutter platen moves away from the web again, preferably in a downward direction, the advancement roller may convey the web into the die-cutter again and convey/push the sheet out of the die-cutting module. The die-cut sheet may be conveyed out of the die-cutting module by one or more kicking rollers.
14. The die-cut sheet may be deposited on a sheet transporting device, e.g. one or more belts. In the meantime, the waste deflector continuous to be in the production mode or position.
15. Now the flat-bed die-cutter may run in the standard operating mode to produce blanks. The movement of the cross-cutter as well as the transporting of material into the waste delivery or into the shredder is terminated. The sheet-transporting device may move the first sheet to a downstream stripping unit. The "infeed" mode is completed.

The following paragraphs (points 1 to 15) are a detailed description of a preferred third further development of the method of the invention of operating a flat-bed die-cutter using a waste delivery. Some of the points of the aforementioned second concrete further development remain unchanged:

1. Unchanged.
2. Unchanged.
3. Unchanged.
4. Unchanged.
5. Unchanged.
6. Unchanged.
7. When the "infeed" mode is started, this may cause a cross-cutter of the waste delivery to be activated and operated in synchronism with web advancement. A (web) storage roller may be moved to an optimum position and stopped/held in this position. An advancement roller may be switched from discontinuous operation to continuous operation. Kicking rollers may be moved, in particular rotated, in such a way that a severed sheet is conveyed into the waste deflector.
8. The die-cutter (and, if applicable, the upstream printing machine) may be started and the web may be moved continuously. In this process, the pull-in roller and, if applicable, the advancement roller may continuously convey the web into the die-cutter. The cross-cutter may sever the web and the kicking rollers may convey the severed section to the waste deflector. From there, the sheet may be conveyed, preferably via a guide plate, to be deposited. Alternatively, the sheet may be moved to a shredder.
9. Unchanged.
10. Unchanged.
11. Unchanged.
12. A cutting die of the die-cutter platen cuts the blanks to be created. One or more kicking rollers may convey the last sheet out of the die-cutter. The waste deflector is deactivated, i.e. switched back into a production mode or moved into a production position as soon as the last sheet has passed the deflector. The cross-cutter may be switched off. At the same time, the web may be continuously conveyed by the pull-in roller. A movable storage roller may store the conveyed web, i.e. a web section, preferably a web section of predefined length. The movement of the storage roller may be effected by a cam disc.
13. Unchanged.
14. Unchanged.
15. Now the flat-bed die-cutter may run in the standard operating mode and produce blanks. The transporting of material into the waste delivery or the shredder is terminated. The transport device may move the first sheet to a downstream stripping unit. The "infeed" mode is completed.

Not all details of the aforementioned further developments need to be implemented; it is possible to implement only a single detail or only a desired selection of details of the respective further development. In addition, a control unit such as a digital computer in particular for storing and processing some or all of the data mentioned below may be provided to implement the respective method.

Combining the features of the invention, the further developments of the invention, and the exemplary embodiments of the invention likewise creates advantageous further developments of the invention. In addition, further developments of the invention may include the individual features or combinations of features disclosed above.

Other features which are considered as characteristic for the invention are set forth in the appended claims.

Although the invention is illustrated and described herein as embodied in a method of operating a flat-bed die cutter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
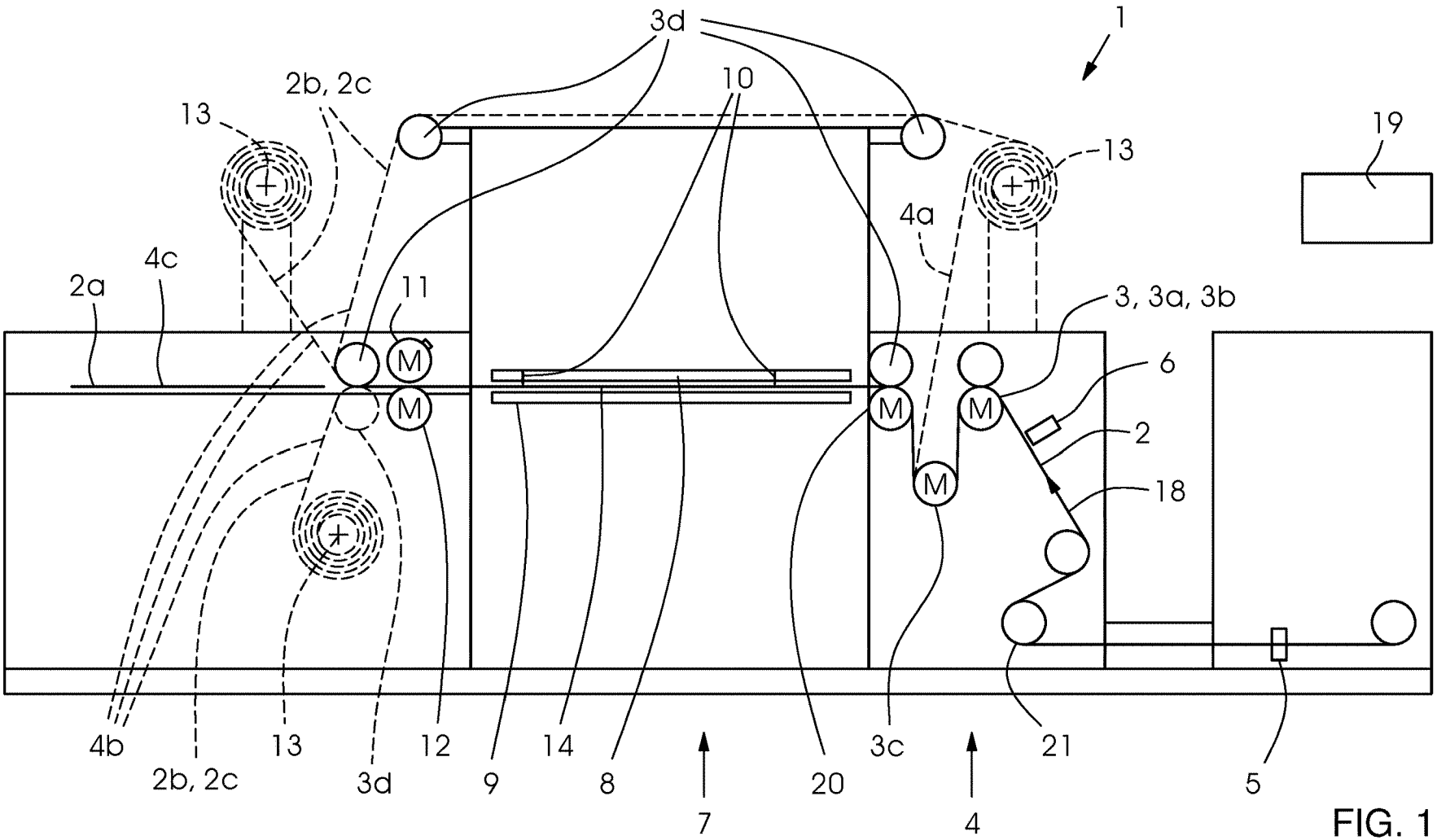
FIG. 1 illustrates the implementation of a first preferred embodiment.

Referring now to the figures of the drawing in detail, each of the figures illustrates a machine 1 implementing different preferred embodiments of the method of the invention. Among other aspects, the following paragraphs describe a die-cutting process; alternatively, it may be an embossing process or a simultaneous die-cutting and embossing process.

Each one of the figures illustrates a machine 1, in particular a flat-bed die-cutter 1 or in particular a machine comprising a flat-bed die-cutter 1. A printing substrate 2 in the form of a web 2, in particular made of paper, cardboard, paperboard, or foil, preferably a web of cardboard, is fed to the die-cutter. The web may be unwound from a (non-illustrated) supply reel. The supply reel may be received on a (non-illustrated) unwinding device.

Preferably the web has a print on at least one side or at least carries a print register mark. The printing operation may be carried out on the same machine, i.e. the machine may comprise at least one printing unit disposed upstream of the die-cutter. The machine may be a printing press with an integrated flat-bed die-cutter or with a flat-bed die-cutter connected in line. The printing unit may be a lithographic offset printing unit, a gravure unit, a relief printing unit or flexographic printing unit or a digital printing unit, in particular an ink printing unit. There may likewise be a number of identical or different upstream printing units. The printing operation may alternatively be carried out by a different machine such as a separate printing machine.

The web is fed in via rollers 3, preferably multiple rollers 3, along a transport path 4, preferably a winding transport path. At least roller 3*a* and/or roller 20 may be (a) pull roller(s), i.e. driven by a motor. At least one roller 3*b* may interact with a counterpart roller or engagement roller. The counterpart roller/engagement roller may have segments. At least a roller 3*c* may be a storage roller, i.e. it may be disposed for movement and driven by a motor. At least roller 3*a* and/or 20 may be a steel roller.

The transport path may comprise a so-called curling sensor 5 and/or a register sensor 6. The curling sensor is used to detect so-called curling, i.e. the formation of undesired waves or other deformation of or damage to the web such as wavy web edges. Curling may be caused by changes in humidity and/or ambient temperature, for example. Curling may cause problems when the printing substrate is processed. The register sensor is used to detect the print register of a print located on the web. The register sensor may be used to detect a bar code or two-dimensional code. The transport path may comprise a decurler 21.

Each one of the figures illustrates a die-cutting module 7 of the flat-bed die-cutter 1. The module may comprise an upper die-cutter platen 8, for instance with a cutting tool or cutting die or cutting plate, and a lower die-cutter platen 9, for instance with a counter-pressure tool/creasing plate. At least one of the two die-cutter platens may be disposed to be movable for die-cutting purposes; the lower die-cutter platen may, for instance, move up and down. At least one of the two platens may comprise die-cutting knives 22, preferably multiple die-cutting knives 22. At least one of the two platens may preferably include a severing knife 10. The severing knife is preferably used to sever the die-cut sheet 2*a* from the web 2. The severing knife may sever the web 2 across its entire width. Alternatively, the severing knife may only partly sever the web, for instance only in the edge region thereof.

Each one of the figures illustrates what is known as an upper kicking roller 11 and a lower kicking roller 12. The kicking rollers are preferably used to grip a severed sheet 2*a*, preferably in the downstream third thereof, and convey it out of the die-cutting module 7. At least one of the kicking rollers preferably comprises a lip, for instance a rubber lip. The said lip may grip a sheet that has been severed from the web.

FIG. 1 illustrates exemplary embodiments preferably including one or more deflection rollers 3*d* and a winding roller 13, preferably driven by a motor. Deflection rollers guide the web 2 to the winding roller along a transport path 4*b*. The winding roller is used to wind up an undesired section 2*b* of the web 2.

Section 2*b* shown in FIG. 1 (and in FIGS. 2 and 3) may exhibit what is known as curling, for instance, or may have become unusable due to another form of deformation, damage, and/or prints. The section is preferably severed from the web by cross-cutting or partial cross-cutting and tearing. The severed section is waste.

FIG. 1 illustrates a first embodiment in which the machine 1 comprises a winding roller 13 disposed upstream of the die-cutting module 7. The web 2 is preferably guided to the winding roller by multiple deflection rollers 3*d*. FIG. 1 illustrates second and third embodiments (in dashed and dash-dotted lines, respectively), in which the respective winding roller is disposed downstream of the die-cutting module 7. The web 2 is preferably guided to the winding roller by a deflection roller 3*d*. The rollers 3*d* are preferably movable. "Upstream" and "downstream" are understood as spatial terms: in the first embodiment 1, the winding roller is disposed on the inlet-side region relative to the module 7; in the second and third embodiments, it is disposed in the outlet-side region thereof. In the first and second embodiments, the respective winding roller is disposed "at the top"; in the third embodiment it is "at the bottom". "At the top" and "at the bottom" are likewise understood as spatial terms: in the first and second embodiments, the respective winding roller is disposed above the plane 14 of the transport path of the printing substrate 2 through the module 7; in the third embodiment, it is disposed below the plane of this path. The preferred embodiment has a short transport path 4*b* corresponding to the second or third embodiment, for instance. If a prior art machine is retrofit, the first embodiment may be preferred if the winding roller has already been provided in a position "upstream of the die-cutting module and below the plane". In all three embodiments, the web 2 is advantageously guided through the die-cutting module 7 before being guided to the winding roller. This provides an advantageous severing of the web in the die-cutting module, preferably using severing elements of the die-cutting module such as one or more die-cutting knives or at least one severing knife.

In addition to the three embodiments, FIG. 1 illustrates how the web is guided to the winding roller 13 in accordance with the prior art: A disadvantage is that the web 2 is guided from the storage roller 3*c* to the winding roller along the transport path 4*a* indicated by dashed lines, i.e. upstream of the die-cutting module 7 and not through the latter.

Figure 2:
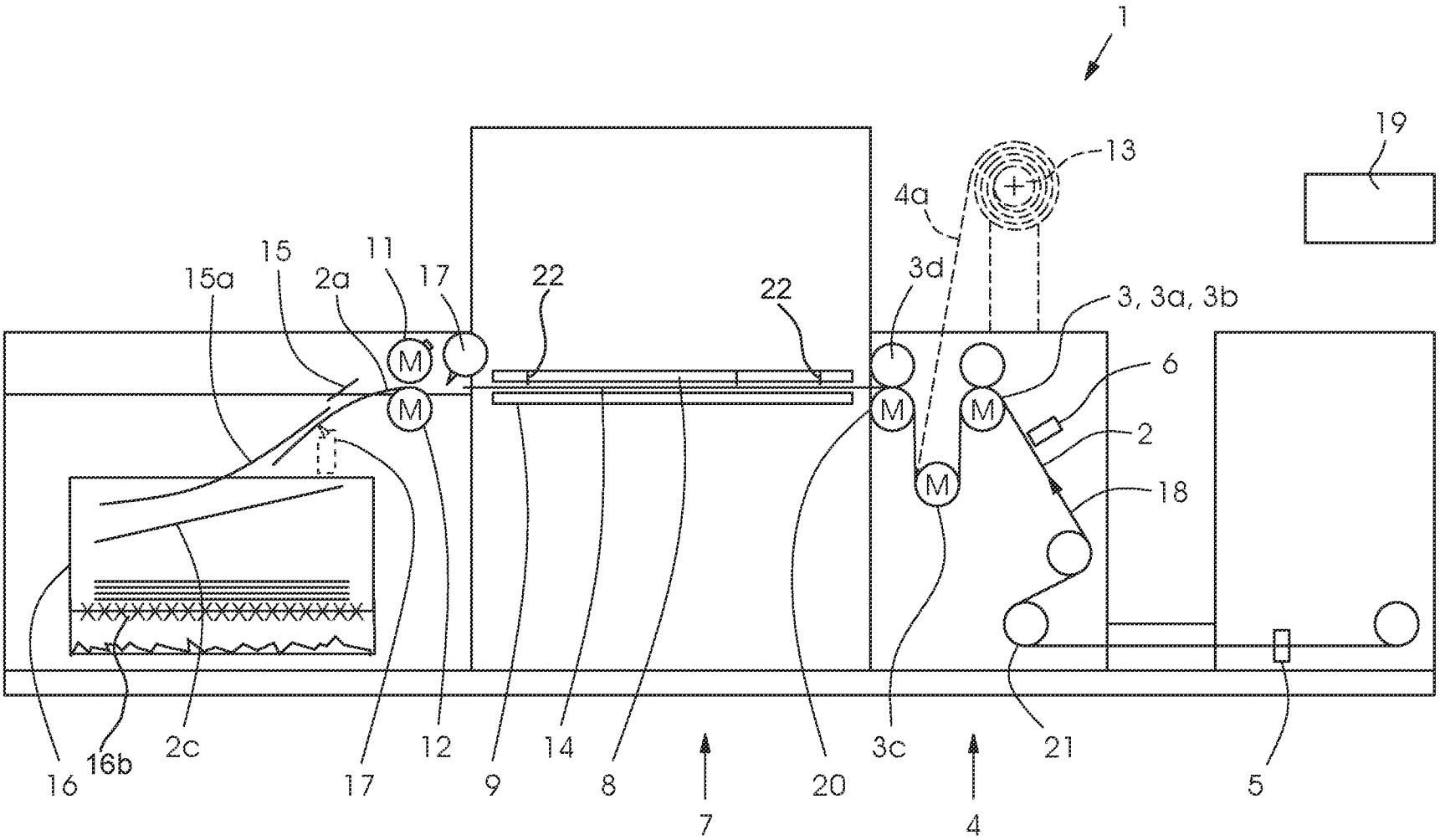
FIG. 2 illustrates the implementation of a second preferred embodiment.

FIG. 2 illustrates two further embodiments (four and five) that preferably include a waste deflector 15, preferably a guide plate 15*a*, and preferably include a waste delivery 16. The deflector guides a severed web section/sheet 2 to the delivery—a process that the guide plate may assist in. In addition or as an alternative to the delivery, a shredder 16*b* for waste may be provided. The web section/sheet 2*a* may likewise be severed from the web 2 by a cutting device 17 such as a rotating cross-cutter 17 or cross-cutter that moves up and down 17, which may be disposed between the die-cutting module 7 and the kicking rollers 11 and 12 or, alternatively (as indicated by the dashed lines), between the kicking rollers and the delivery. This embodiment does without the winding roller 13; however, it may still be present for a different purpose.

Figure 3:
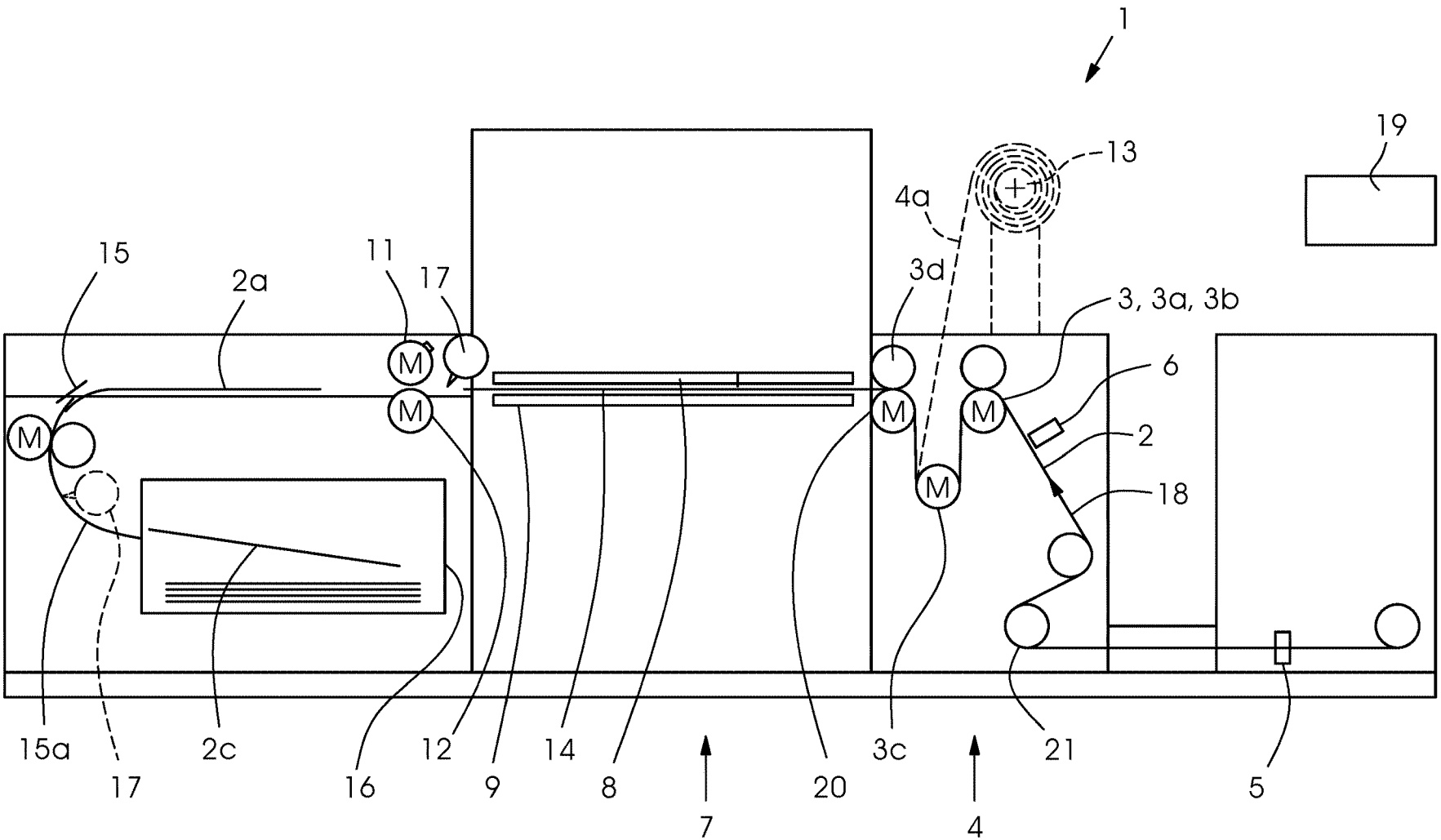
FIG. 3 illustrates the implementation of a third preferred embodiment.

FIG. 3 illustrates two further embodiments (six and seven) that preferably likewise include a waste deflector 15, preferably a guide plate 15*a*, and preferably include a waste delivery 16. The deflector guides a severed web section/sheet 2*a* to the delivery—a process that the guide plate may assist in. In addition or as an alternative to the delivery, a shredder 16*b* for the waste may be provided. The web section/sheet 2*a* may likewise be severed from the web 2 by a cutting device 17 such as a rotating cross-cutter 17, which may be disposed between the die-cutting module 7 and the kicking rollers 11 and 12 or, alternatively (as indicated by the dashed lines), between the kicking rollers and the delivery. This embodiment does without the winding roller 13; however, it may still be present for a different purpose.

The following is a summary list of reference numerals and the corresponding structure used in the above description of the invention:

1 machine or flat-bed die-cutter
2 printing substrate or web
2*a* sheet
2*b* web section
2*c* waste
3 rollers
3*a* pull-in roller
3*b* roller and counterpart roller
3*c* storage roller
3*d* deflection rollers
4 transport path (web infeed)
4*a* transport path
4*b* transport path
4*c* transport path (die-cut product)

5 curling sensor
6 register sensor
7 die-cutting module
8 upper die-cutter platen
9 lower die-cutter platen
10 severing knife
11 upper kicking roller
12 lower kicking roller
13 winding roller
14 plane
15 waste deflector
15*a* guide plate
16 waste delivery
17 cutting device or cross-cutter
18 printed image
19 control unit
20 advancement roller
21 decurler

The invention claimed is:

1. A method of operating a flat-bed die-cutter, the method comprising:

feeding a printing substrate in the form of a web to a die-cutting module of the flat-bed die-cutter and guiding the web through the die-cutting module;

severing a web section from the web downstream of the die-cutting module by either, cutting the web section off by a cross-cutter that rotates or moves up and down and is different from a die-cutting knife of the die-cutting module; or only partly cutting the web section off by a cross-cutter that rotates or moves up and down and is different from the die-cutting knife of the die-cutting module and then tearing off the web section; and removing the web section as waste by at least one of winding the waste onto a winding roller, depositing web sections into a waste delivery or shredding the web sections;

operating the die-cutting module, during or after removing the web section, in-register at a matching speed relative to the speed of a printed image of a print on the web; and starting the feeding of the web to the flat-bed die-cutter and guiding of the web through the die-cutting module at a beginning of a production run, continuing the feeding and guiding without interruption during the removal of the web section and the in-register die-cutting of the web at the matching speed, and not stopping the feeding and guiding until production ends.

2. The method according to claim 1, which comprises moving the severed web section out of the die-cutting module by way of a pair of rollers.

3. The method according to claim 2, wherein the cross-cutter is disposed upstream or downstream of the pair of rollers.

4. The method according to claim 1, wherein a cross-cutter is disposed upstream or downstream of the pair of rollers.

5. The method according to claim 1, which comprises removing the web sections out of a transport path by way of a deflector.

* * * * *